US012077714B2

(12) United States Patent
Koseoglu et al.

(10) Patent No.: US 12,077,714 B2
(45) Date of Patent: Sep. 3, 2024

(54) NEEDLE COKE PRODUCTION FROM HPNA RECOVERED FROM HYDROCRACKING UNIT

(71) Applicant: SAUDI ARABIAN OIL COMPANY, Dhahran (SA)

(72) Inventors: Omer Refa Koseoglu, Dhahran (SA); Ali Alzaid, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/710,856

(22) Filed: Dec. 11, 2019

(65) Prior Publication Data

US 2021/0179945 A1 Jun. 17, 2021

(51) Int. Cl.

| | |
|---|---|
| ***C10G 67/06*** | (2006.01) |
| ***C10B 57/04*** | (2006.01) |
| ***C10B 57/06*** | (2006.01) |
| *C10B 57/00* | (2006.01) |

(52) U.S. Cl.

CPC ..... *C10B 57/06* (2013.01); *C10B 57/045* (2013.01); *C10B 57/005* (2013.01)

(58) Field of Classification Search

CPC ..... C10G 55/04; C10G 25/12; C10G 67/04; C10G 67/0454; C10G 67/06; C10G 69/06; C10G 2300/708; C10G 9/005; C10G 67/0445; C10G 53/04; C10G 53/06; C10G 53/08; C10B 55/00; C10B 55/02; C10B 57/04; C10B 57/06; C10B 57/045; C10B 57/005

See application file for complete search history.

(56) References Cited

U.S. PATENT DOCUMENTS 3,563,884 A * 2/1971 Bloomer ..... C10B 55/00 208/81
3,617,515 A * 11/1971 Bloomer ..... C10B 55/00 208/81
4,116,815 A * 9/1978 Sunago ..... C10L 9/02 208/87

(Continued)

FOREIGN PATENT DOCUMENTS

| | | | |
|---|---|---|---|
| JP | 2017048380 | A | 3/2017 |
| KR | 20170084887 | A | 7/2017 |
| WO | 2018152517 | A1 | 8/2018 |

OTHER PUBLICATIONS

International Search Report issued in corresponding International Application No. PCT/US2020/014938, mailed Jul. 30, 2020 (5 pages).

(Continued)

*Primary Examiner* — Michelle Stein

(74) *Attorney, Agent, or Firm* — Osha Bergman Watanabe & Burton LLP

(57) ABSTRACT

A process for the treatment of a hydrocracking unit bottoms stream containing heavy poly-nuclear aromatic (HPNA) compounds and/or a fresh hydrocracking feedstock stream containing HPNA precursors to produce coke. The HPNA and/or HPNA precursors are removed from the hydrocracking unit bottoms stream and/or a fresh hydrocracking feedstock stream by solvent washing, and the HPNA and/or HPNA precursors are subjected to delayed coking for the production of coke.

14 Claims, 6 Drawing Sheets

(56) References Cited

U.S. PATENT DOCUMENTS

| | | | | |
|---|---|---|---|---|
| 4,676,886 | A * | 6/1987 | Rahbe | C10B 55/00 208/131 |
| 4,775,460 | A | 10/1988 | Reno | |
| 5,120,427 | A * | 6/1992 | Stine | C10G 49/22 208/100 |
| 5,190,633 | A | 3/1993 | Fetzer et al. | |
| 5,286,371 | A * | 2/1994 | Goval | C10B 55/00 208/50 |
| 5,350,503 | A * | 9/1994 | Freymeyer | C10B 55/00 208/131 |
| 8,343,334 | B2 | 1/2013 | Koseoglu | |
| 8,828,219 | B2 | 9/2014 | Koseoglu | |
| 8,894,841 | B2 | 11/2014 | Koseoglu | |
| 9,394,493 | B2 | 7/2016 | Koseoglu | |
| 9,534,179 | B2 | 1/2017 | Koseoglu | |
| 10,351,778 | B2 * | 7/2019 | Iqbal | C10B 57/045 |
| 11,066,607 | B1 * | 7/2021 | Koseoglu | C10G 25/12 |
| 2008/0105595 | A1 * | 5/2008 | Koseoglu | C10G 25/003 208/91 |
| 2009/0120842 | A1 * | 5/2009 | Koseoglu | C10G 25/003 208/250 |
| 2009/0314689 | A1 | 12/2009 | Varadaraj et al. | |
| 2012/0187027 | A1 * | 7/2012 | Koseoglu | C10G 67/06 208/91 |
| 2013/0026064 | A1 * | 1/2013 | Koseoglu | C10G 9/005 208/53 |
| 2013/0248416 | A1 | 9/2013 | Shafi et al. | |
| 2016/0053189 | A1 | 2/2016 | Wang et al. | |
| 2017/0029724 | A1 * | 2/2017 | Koseoglu | C10G 9/005 |
| 2017/0066971 | A1 * | 3/2017 | Koseoglu | C10G 49/007 |
| 2017/0306239 | A1 * | 10/2017 | Koseoglu | C01B 32/05 |
| 2017/0306240 | A1 * | 10/2017 | Koseoglu | C10G 21/003 |
| 2018/0187100 | A1 | 7/2018 | Koseoglu | |
| 2018/0282640 | A1 * | 10/2018 | Koseoglu | C10B 57/08 |
| 2019/0153323 | A1 | 5/2019 | Koseoglu | |
| 2020/0377797 | A1 * | 12/2020 | Koseoglu | C10B 57/12 |

OTHER PUBLICATIONS

Written Opinion issued in corresponding International Application No. PCT/US2020/014938, mailed Jul. 30, 2020 (8 pages).

International Preliminary Report on Patentability issued in corresponding International Application No. PCT/US2020/014938, mailed Jun. 23, 2022 (9 pages).

Alawani et al., "Evaluation of Polycyclic Aromatic Hydrocarbon Removal from Hydrocracking Recycle Streams," Energy & Fuels, 2020, 34, 179-187, 9 pages.

* cited by examiner

NEEDLE COKE PRODUCTION FROM HPNA RECOVERED FROM HYDROCRACKING UNIT

BACKGROUND

Hydrocracking processes are used commercially in a large number of petroleum refineries. They are used to process a variety of feeds boiling in the range of 370° C. to 520° C. in conventional hydrocracking units and boiling at 520° C. and above in residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen to carbon ratio and by removing organosulfur and organonitrogen compounds.

Hydrotreating and hydrocracking units generally include two principal zones, reaction and separation. Key parameters such as feedstock quality, product specification/processing objectives and catalysts typically determine the configuration of the reaction zone.

Mild hydrocracking or single stage once-through hydrocracking occurs at operating conditions that are more severe than hydrotreating processes, and less severe than conventional full pressure hydrocracking processes. This hydrocracking process is more cost effective, but typically results in lower product yields and qualities. The mild hydrocracking process produces less mid-distillate products of a relatively lower quality as compared to conventional hydrocracking. Single or multiple catalysts systems can be used depending upon the feedstock processed and product specifications. Single stage hydrocracking is the simplest configuration, and are designed to maximize mid-distillate yield over a single or dual catalyst systems. Dual catalyst systems are used in a stacked-bed configuration or in two different reactors.

In a series-flow configuration, the entire hydrotreated/hydrocracked product stream from the first reactor, including light gases including $C_1$-$C_4$, $H_2S$, $NH_3$, and all remaining hydrocarbons, are sent to the second reactor. In two-stage configurations, the feedstock is refined by passing it over a hydrotreating catalyst bed in the first reactor. The effluents are passed to a fractionator column to separate the $H_2S$, $NH_3$, light gases ($C_1$-$C_4$), naphtha and diesel products boiling in the temperature range of 36–370° C. The hydrocarbons boiling above 370° C. are then passed to the second reactor.

In addition to sulfur-containing and nitrogen-containing compounds, a typical hydrocracking feedstream, such as vacuum gas oil (VGO), contains poly nuclear aromatic (PNA) compounds, i.e., those containing less than seven fused benzene rings. As the feedstream is subjected to hydroprocessing at elevated temperature and pressure, heavy poly nuclear aromatic (HPNA) compounds, i.e., those containing seven or more fused benzene rings, tend to form and are present in high concentration in the unconverted hydrocracker bottoms.

In addition, formation of HPNA compounds is an undesirable side reaction that occurs in recycle hydrocracker bottoms streams. The HPNA molecules form by dehydrogenation of larger hydro-aromatic molecules or cyclization of side chains onto existing HPNAs followed by dehydrogenation, which is favored as the reaction temperature increases. HPNA formation depends on many known factors including the type of feedstock, catalyst selection, process configuration, and operating conditions. Since HPNAs accumulate in the recycle system and then cause equipment fouling, HPNA formation must be controlled in the hydrocracking process.

Formation of HPNA is a common problem in hydrocracking operations. Problems in hydrocracking units caused by the accumulation of polynuclear aromatics (PNAs) are becoming more widespread as heavier and heavier feedstocks are being processed and conversion has increased closer to 100%. There are several prior art methods of successfully dealing with the HPNA formation and removal in hydrocracking units. Some of these methods are outlined in U.S. Pat. Nos. 9,534,179; 9,394,493; 8,828,219 and 8,343,334. These methods are primarily based on fractionation and adsorption methods.

Various processes have been proposed for removal of compounds that reduce the efficiency of the hydrocracking unit and/or the quality of the products produced. For example, a two-stage process for the removal of polycyclic aromatics from hydrocarbon feedstreams in disclosed in U.S. Pat. No. 4,775,460. The first stage includes contacting the feedstream with a metal-free alumina to form polycyclic compounds or their precursors; this is followed by a second stage for removing the polycyclic compounds by contacting the feed with a bed of adsorbent, such as charcoal. These process steps are conducted at elevated temperatures, relatively low pressure, and preferably in the absence of hydrogen to avoid any hydrocracking of the heavy feedstream.

A process is disclosed in U.S. Pat. No. 5,190,633 for the separation and removal of stable polycyclic aromatic dimers from the effluent stream of the hydrocracking reactor that employs an adsorption zone, suitable adsorbents being identified as molecular sieves, silica gel, activated carbon, activated alumina, silica-alumina gel and clays. The adsorbent is preferably installed in a fixed-bed, in one or more vessels, and either in series or parallel flow; the spent zone of adsorbent can be regenerated. The heavy hydrocarbon oil passing through the adsorption zone is then recycled to the hydrocracking zone for further processing and conversion of lower boiling hydrocarbons.

For example, U.S. Pat. Nos. 9,534,179 and 8,828,219 use a two stage process of contacting both the heavy hydrocarbon feedstream, which contains PNAs, and the hydrocracker bottoms stream, which contains HPNAs with an effective amount of adsorbent material to produce an adsorbent-treated fractionator bottoms stream having a reduced content of heavy poly-nuclear aromatic compounds.

U.S. Pat. Nos. 9,394,493 and 8,343,334 use a series of fractionators and hydroprocessing reactors to convert byproducts, including HPNA and PNA to lighter hydrocarbon fuels, such as gasoline and diesel.

While the above-mentioned references are suitable for their intended purposes, a need remains for improved process and apparatus for efficient and efficacious hydrocracking of heavy oil fraction feedstocks.

SUMMARY

In one aspect, embodiments disclosed herein relate to a process for the treatment of a hydrocracking unit bottoms stream containing heavy poly-nuclear aromatic (HPNA) compounds and/or a fresh hydrocracking feedstock stream containing HPNA precursors to produce coke. The process including contacting the hydrocracking unit bottoms stream and/or the fresh hydrocracking feedstock stream with an effective amount of adsorbent material in an adsorption unit to produce an adsorbent laden with HPNA compounds and HPNA precursors and an adsorbent treated hydrocarbon stream; washing the adsorbent laden with HPNA compounds and HPNA precursors with one or more solvents to extract the HPNA compounds and HPNA precursors and produce a solvent effluent stream; recovering and introducing the solvent effluent stream from the adsorption unit into a separation unit; recovering the one or more solvents from the separation unit for re-use as the one or more solvents; recovering the HPNA compounds and HPNA precursors from the separation unit; and subjecting the HPNA compounds and HPNA precursors to a delayed coking process for the formation of needle, anode, or fuel grade coke.

In other aspects, embodiments disclosed herein relate to a process for the treatment of a hydrocracking unit bottoms stream containing heavy poly-nuclear aromatic (HPNA) compounds and/or a fresh hydrocracking feedstock stream containing HPNA precursors to produce coke. The process including contacting the hydrocracking unit bottoms stream and/or the fresh hydrocracking feedstock stream with an effective amount of a carbon based adsorbent material in an adsorption unit to produce an adsorbent laden with HPNA compounds and HPNA precursors and an adsorbent treated hydrocarbon stream; recovering the adsorbent laden with the HPNA compounds and HPNA precursors from the adsorption unit; and subjecting the adsorbent laden with the HPNA compounds and HPNA precursors from the adsorption unit to a delayed coking process for the formation of needle, anode, or fuel grade coke.

In yet other aspects, embodiments disclosed herein relate to a system for the treatment of a hydrocracking unit bottoms stream containing heavy poly-nuclear aromatic (HPNA) compounds and/or a fresh hydrocracking feedstock stream containing HPNA precursors and production of coke. The system including an adsorption unit containing an effective amount of adsorbent material to adsorb the HPNA compounds and HPNA precursors and produce an adsorbent treated hydrocarbon stream; a solvent feedstream configured for washing the adsorbent material, producing a solvent effluent stream HPNA compounds and HPNA precursors; a separation unit for separating the solvent from the HPNA compounds and HPNA precursors; and a delayed coking unit configured for converting the HPNA compounds and HPNA precursors to needle, anode, or fuel grade coke.

Other aspects and advantages will be apparent from the following description and the appended claims.

DETAILED DESCRIPTION

Figure 1:
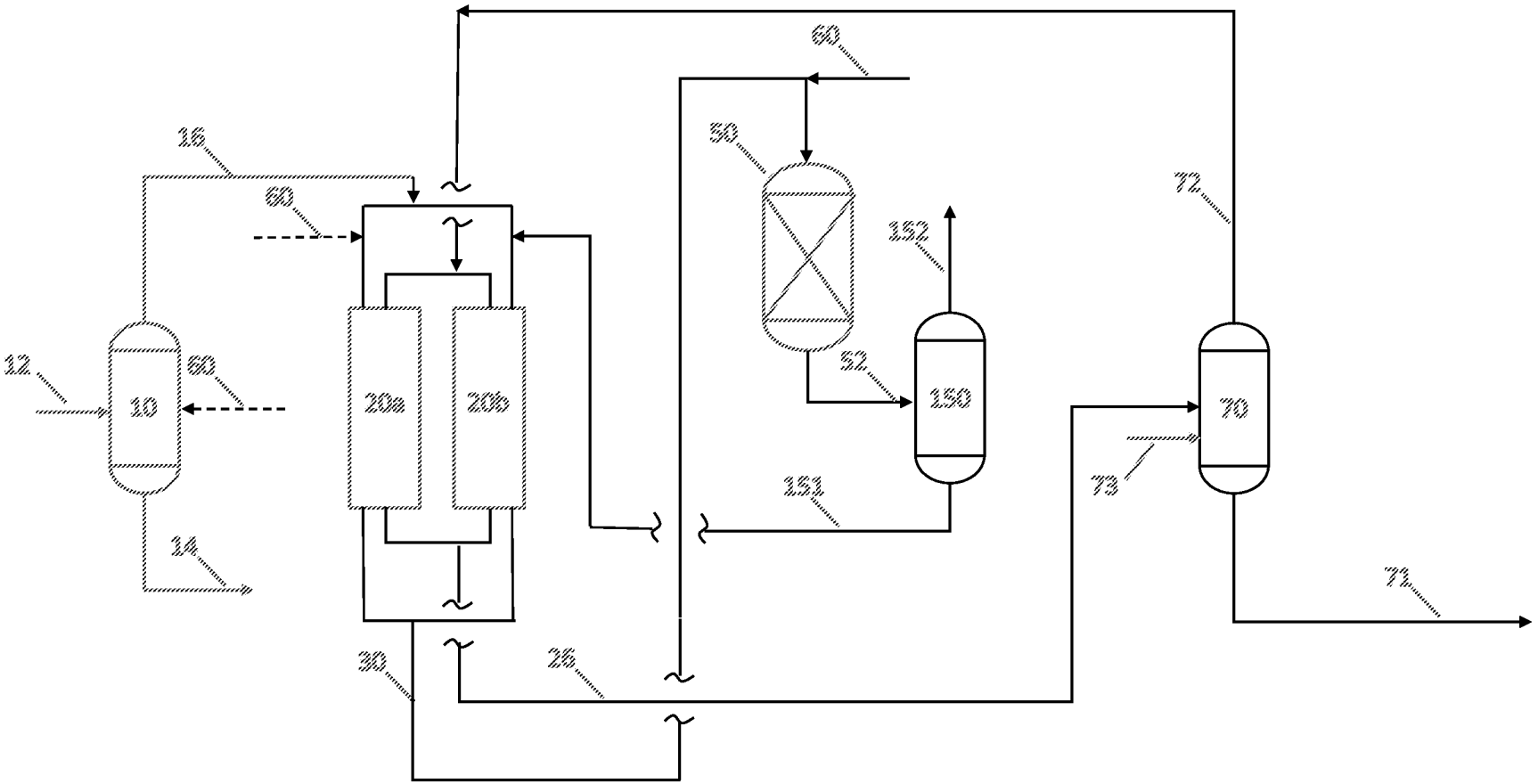
FIG. 1 is a process flow diagram of an adsorption process according to one or more embodiments disclosed herein.

According to one or more embodiments disclosed herein, is a method to produce needle, anode, or fuel grade coke from the HPNA and/or HPNA precursors (also known as PNAs) recovered from a hydrocracking process. As discussed above, the presence of PNAs in heavy oil fraction feedstocks or HPNA formed in the hydrocracking process have a detrimental effect on the performance of the hydrocracking unit. Whereas in prior art methods the removed HPNA is either sent to fuel oil stream or burned in power plants together with adsorbents, in accordance with one or more embodiments of the present disclosure, hydrocracking feedstock and or unconverted hydrocracker bottoms recycle streams are treated using an adsorbent (e.g., activated carbon, attapulgus clay) to remove or reduce the content of HPNA and HPNA precursors. The adsorbent is then solvent treated to recover the HPNA or HPNA precursors, which were then subjected to delayed coking to produce a green (raw) coke. The type of coke produced (after calcining the green coke) is feedstock dependent. For example, HPNA from recycle stream, which has low sulfur and nitrogen, produces needle coke, and HPNA precursors from the hydrocracking feedstock, which contains high levels of sulfur and nitrogen, produces fuel grade coke. Anode coke, which has an intermediate amount of sulfur, relative to needle coke and fuel-grade coke, may be formed by either feedstock (depending on the contents of the particular feedstock in any given process), but in particular embodiments, may be formed from the recycle stream. If the adsorbents are carbon based, the adsorbents containing HPNA or HPNA precursors can be subjected to delayed coking to obtain the green coke, which may be subsequently calcined to result in needle, anode, or fuel grade coke.

Accordingly, integrated processes and apparatus are disclosed herein for hydrocracking hydrocarbon feeds, such as a combined feed of VGO and demetalized oil (DMO) and/or deasphalted oil (DAO), in an efficient manner and resulting in improved product quality. The presence of nitrogen-containing compounds, sulfur-containing compounds and PNA compounds in DMO or DAO feedstreams, and the presence of HPNA compounds in hydrocracker bottoms, have detrimental effects on the performance of hydrocracking unit. Additionally, the integrated processes and apparatus provided herein remove or reduce the concentration of nitrogen-containing compounds and/or sulfur-containing compounds which would decrease the coke quality produced from the PNAs and HPNAs thereby improving process efficiency and product quality.

In general, the processes include feeding a first heavy hydrocarbon feedstream and/or a hydrocracking reaction bottoms stream, to a demetalizer/deasphalter to remove metals/asphaltenes and nitrogen-containing and/or sulfur-containing compounds and produce a DMO or DAO. The DMO/DAO may be fed to an adsorber with an effective quantity of adsorbent material in which PNA compounds and/or HPNA compounds are adsorbed. The adsorbent effluent may contain about 85%/v to about 95%/v of the first heavy hydrocarbon feedstream and/or about 10%/v to about %/v, in certain embodiments about 20%/v to about 50%/v, and in further embodiments about 30%/v to about 40%/v of the hydrocracking bottoms recycle stream. The adsorber effluent may be combined with a second hydrocarbon feedstream and cracked in the presence of hydrogen in a hydrocracking reaction zone. The PNA and/or HPNA containing adsorbent may be washed with a solvent to recover a solvent laden with PNA and/or HPNA. The PNA and/or HPNA may be separated from the solvent in a fractionation system. The recovered PNA and/or HPNA stream may then be sent to a delayed coking process for production of coke.

The demetalized oil (DMO) or deasphalted oil (DAO) may have a boiling point of from about 450° C. to about 800° C., and in certain embodiments of from about 500° C. to about 700° C.

While the embodiments disclosed herein should not be limited to these embodiments, one or more embodiments are described with respect to FIGS. 1-6, where like numbers represent like parts.

In one or more embodiments, and referring to FIG. 1, a process flow diagram of an integrated process for the treatment of heavy hydrocarbon feedstream and/or a hydrocracking reaction bottoms stream and production of coke is illustrated. A heavy hydrocarbon feedstream and/or a hydrocracking reaction bottoms stream 12 may be fed to a solvent de-metalizing or de-asphalting unit 10. Metals/asphaltenes as well as nitrogen and sulfur rich compounds may be removed via flow line 14, while a demetalized oil (DMO) or deasphalted oil (DAO) may be recovered via flow line 16. The DMO/DAO 16 may then be fed to adsorber 20*a*/20*b*, which may have an effective quantity of adsorbent material in which PNA compounds and/or HPNA compounds are adsorbed.

In certain embodiments, the adsorption zone including adsorbers 20*a* and 20*b* may be operated in swing mode so that the adsorption of HPNA/PNA is continuous. When the adsorbent material in adsorber 20*a* or 20*b* becomes saturated with adsorbed PNA compounds and/or HPNA compounds, the flow of the DMO/DAO 16 and solvent 72 may be directed to the other adsorber.

For example, in operation of the adsorber system 20*a* and 20*b*, the DAO/DMO 16 may be fed to adsorber 20*a* while a polar solvent stream 72 may be fed to adsorber 20*b*. The concentrations of PNA compounds present in the in the heavy hydrocarbon feedstream, and HPNA compounds from the hydrocracking reaction bottoms stream, are reduced in the adsorption zone 20*a* by contact with adsorbent. When the adsorbent in adsorber 20*a* has adsorbed a quantity of PNA/HPNA where the adsorption efficiency begins to decrease, feed of DAO/DMO 16 to adsorber 20*a* may be switched to adsorber 20*b* while feed of solvent 72 to adsorber 20*b* may be switched to adsorber 20*a*.

The adsorbers 20*a* and 20*b* may be packed bed columns which are gravity fed or pressure force-fed sequentially in order to permit continuous operation when one bed is being regenerated, i.e., swing mode operation. The packing can be in the form of pellets, spheres, extrudates or natural shapes, having a size of about 4 mesh to about 60 mesh, and in certain embodiments about 4 mesh to about 20 mesh, based on United States Standard Sieve Series.

The packed columns may be operated at a pressure in the range of from about 1 $kg/cm^2$ to about 30 $kg/cm^2$, in certain embodiments about 1 $kg/cm^2$ to about 20 $kg/cm^2$, and in further embodiments about 1 $kg/cm^2$ to about 10 $kg/cm^2$, a temperature in the range of from about 20° C. to about 250° C., in certain embodiments about 20° C. to about 150° C., and in further embodiments about 20° C. to about 100° C.; and a liquid hourly space velocity of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$.

An adsorbent-treated hydrocarbon stream 30 is discharged from adsorber 20*a*/20*b* and conveyed to hydrocracking reaction zone 50, along with a second hydrocarbon feedstream 60. An effective quantity of hydrogen for hydrocracking reactions may also be provided with the second hydrocarbon feedstock 60. Hydrocracking reaction effluents 52 may be discharged from hydrocracking reaction zone 50 and sent to a separation section 150. In one or more embodiments, the separation section 150 may include one or more gas/liquid separators and one or more fractionation towers. Overhead product 152 may be recovered as well as bottoms product 151. Separation section 150 may be designed to have a cut point above 370° C., such that overhead product 152 may be sent to downstream blending in refinery operations to produce gasoline, kerosene, diesel, or other fuel oils. Additionally, bottoms product 151 may be recycled to the adsorbers 20*a*/20*b* for recovery of additional HPNA and/or HPNA precursors.

The second heavy hydrocarbon feedstream 60 may be a hydrocarbon such as VGO from a vacuum distillation operation, and may have a boiling point of from about 350° C. to about 600° C., and in certain embodiments from about 350° C. to about 570° C. In one or more embodiments, the second hydrocarbon feedstock 60 may be fed to the solvent de-metalizing or de-asphalting unit 10 with the heavy hydrocarbon feedstream and/or the hydrocracking reaction bottoms stream 12. In other embodiments, the second hydrocarbon feedstock 60 may be fed to the adsorbers 20*a* and 20*b* with the DAO/DMO 16.

Additionally, the solvent de-metalizing or de-asphalting unit 10, hydrocracking reaction zone 50, and separation section 150 may be operated based on the feedstock quality and desired coke specification. For example, in one or more embodiments, if needle coke production is desired, the hydrocracking unit 50 may be fed with the second hydrocarbon feedstock 60 and with no heavy hydrocarbon feedstream and/or a hydrocracking reaction bottoms stream 12 being fed to the solvent de-metalizing or de-asphalting unit 10. If the heavy hydrocarbon feedstream and/or a hydrocracking reaction bottoms stream 12 and second hydrocarbon feedstock 60 have low levels of sulfur, both stream can be processed to produce a high quality coke.

Suitable reaction apparatus for the hydrocracking reaction zone include fixed bed reactors, moving bed reactor, ebullated bed reactors, baffle-equipped slurry bath reactors, stirring bath reactors, rotary tube reactors, slurry bed reactors, or other suitable reaction apparatus. In one or more embodiments, such as with VGO and similar feedstreams, fixed bed reactors may be utilized. In other embodiments, such as those for heavier feedstreams and other difficult to crack feedstreams, ebullated bed reactors may be utilized.

In general, the operating conditions for the reactor of a hydrocracking zone include: reaction temperature of about 300° C. to about 500° C., in certain embodiments about 330° C. to about 475° C., and in further embodiments about 330° C. to about 450° C.; hydrogen partial pressure of about 60 $kg/cm^2$ to about 300 $kg/cm^2$, in certain embodiments about 100 $kg/cm^2$ to about 200 $kg/cm^2$, and in further embodiments about 130 $kg/cm^2$ to about 180 $kg/cm^2$; liquid hourly space velocity of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$; hydrogen/oil ratio of about 500 normalized $m^3$ per $m^3$ ($Nm^3/m^3$) to about 2500 $Nm^3/m^3$, in certain embodiments about 800 $Nm^3/m^3$ to about 2000 $Nm^3/m^3$, and in further embodiments about 1000 $Nm^3/m^3$ to about 1500 $Nm^3/m^3$.

In certain embodiments, the hydrocracking catalyst may include any one of or combination including amorphous alumina catalysts, amorphous silica alumina catalysts, natural or synthetic zeolite based catalyst, or a combination thereof. The hydrocracking catalyst can possess an active phase material including, in some embodiments, any one of or combination including Ni, W, Mo, or Co. In one or more embodiments acidic alumina or silica alumina based catalysts loaded with Ni—Mo or Ni—W active metals, or combinations thereof, are used. In other embodiments For desorption, solvent 72 may be fed to adsorber 20*a* or 20*b* to desorb the PNA compounds and/or HPNA compounds and discharge the PNA/HPNA laden solvent 26 from the adsorption zone. PNA/HPNA laden solvent 26 may be fed to fractionation unit 70 where the solvent is separated from the PNA compounds and/or HPNA compounds. The recovered solvent stream 72 is recycled back to adsorption zone, while fresh, or make-up, solvent 73 may be fed to fractionation unit 70. The bottoms stream 71 from the fractionation unit 70 containing the PNA compounds and/or HPNA compounds is discharged and may be fed downstream to a delayed coking process for production of coke.

Figure 2:
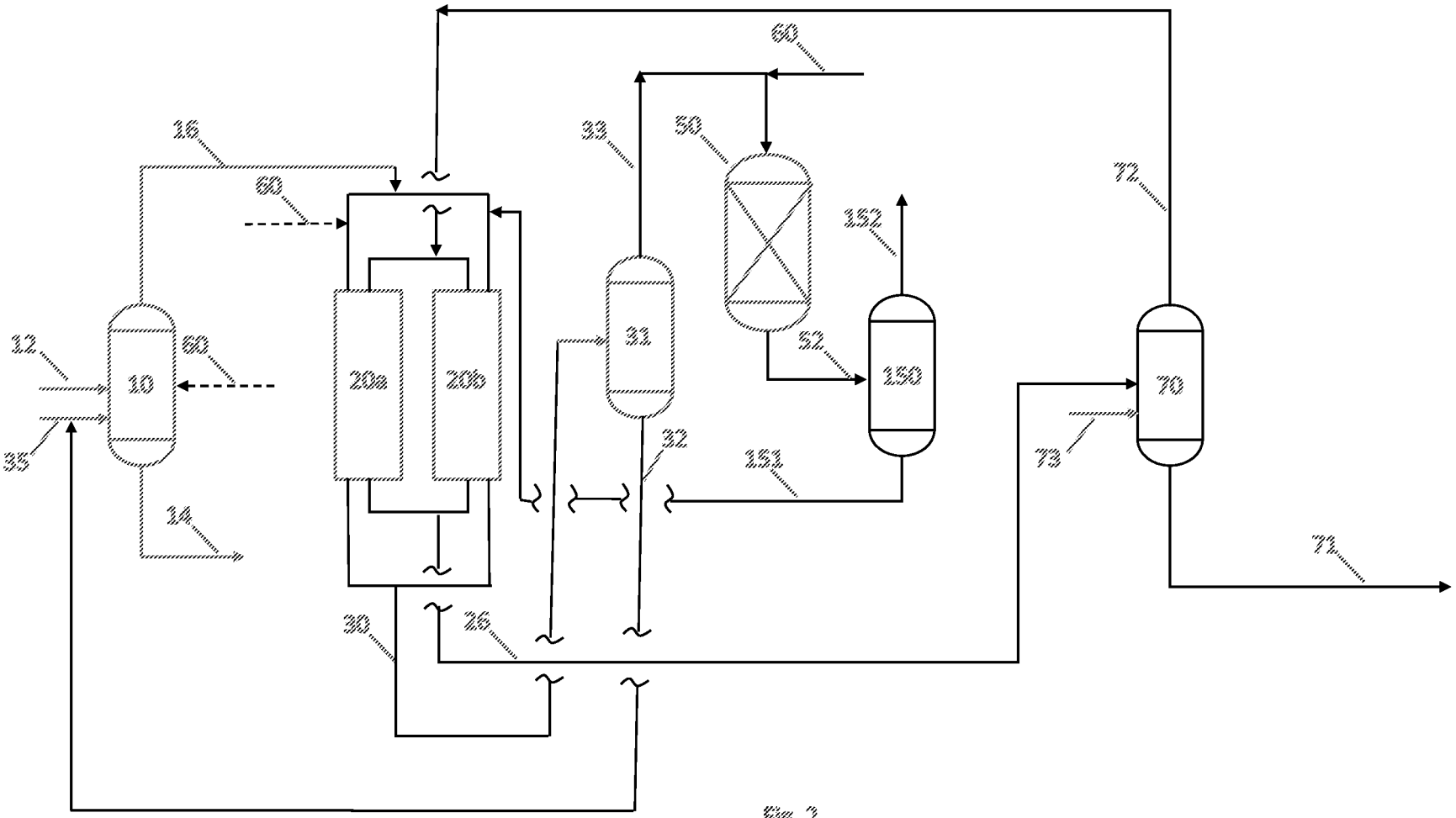
FIG. 2 is a process flow diagram of an adsorption process according to one or more embodiments disclosed herein.

Referring now to FIG. 2, in one or more embodiments, a non-polar solvent 35 may be fed to the solvent de-metalizing or de-asphalting unit 10 if DMO/DAO 16 is too thick to feed to the adsorbent bed in adsorber 20*a*/20*b* without clogging the adsorbent. In such embodiments, the DMO/DAO 16 recovered from the asphalting unit 10 may include the solvent to be transported to the adsorbers 20*a*/20*b*. In such embodiments, the solvent may be separated from the adsorbent-treated hydrocarbon stream 30, in an intermediate separation column 31, prior to the adsorbent treated hydrocarbon being conveyed to hydrocracking reaction zone 50 via overhead flow line 33. The separated solvent may be recycled to the solvent de-metalizing or de-asphalting unit 10 via flow line 32.

In one or more embodiments, the polar solvents and non-polar solvents may be selected based on their Hildebrand solubility factors or by their two-dimensional solubility factors. Solvents can be introduced at a solvent to oil volume ratio of about 1:1 to about 10:1.

The overall Hildebrand solubility parameter is a well-known measure of polarity and has been calculated for numerous compounds. The complexing solubility parameter component, which describes the hydrogen bonding and electron donor acceptor interactions, measures the interaction energy that requires a specific orientation between an atom of one molecule and a second atom of a different molecule. The field force solubility parameter, which describes the van der Waals and dipole interactions, measures the interaction energy of the liquid that is not destroyed by changes in the orientation of the molecules.

In one or more embodiments using a non-polar solvent or solvents (if more than one is employed), the non-polar solvent(s) may have an overall Hildebrand solubility parameter of less than about 8.0 $(cal/cm^3)^{1/2}$ or the complexing solubility parameter of less than 0.5 and a field force parameter of less than 7.5. Suitable non-polar solvents may include, e.g., saturated aliphatic hydrocarbons such as pentanes, hexanes, heptanes, paraffinic naphtha (C5-C11), kerosene (C12-C15), diesel (C16-C20), normal and branched paraffins, aromatics, or mixtures or any of these solvents. In one or more embodiments, solvents(s) may be C5-C7 paraffins and C5-C11 naphtha.

In one or more embodiments using polar solvent(s) for desorption, polar solvents are selected having an overall solubility parameter greater than about 8.5 $(cal/cm^3)^{1/2}$, or a complexing solubility parameter of greater than 1 and field force parameter of greater than 8. Examples of polar solvents meeting the desired minimum solubility parameter are toluene (8.91 $(cal/cm^3)^{1/2}$), benzene (9.15 $(cal/cm^3)^{1/2}$), xylenes (8.85 $(cal/cm^3)^{1/2}$), and tetrahydrofuran (9.52 $(cal/cm^3)^{1/2}$).

Figure 3:
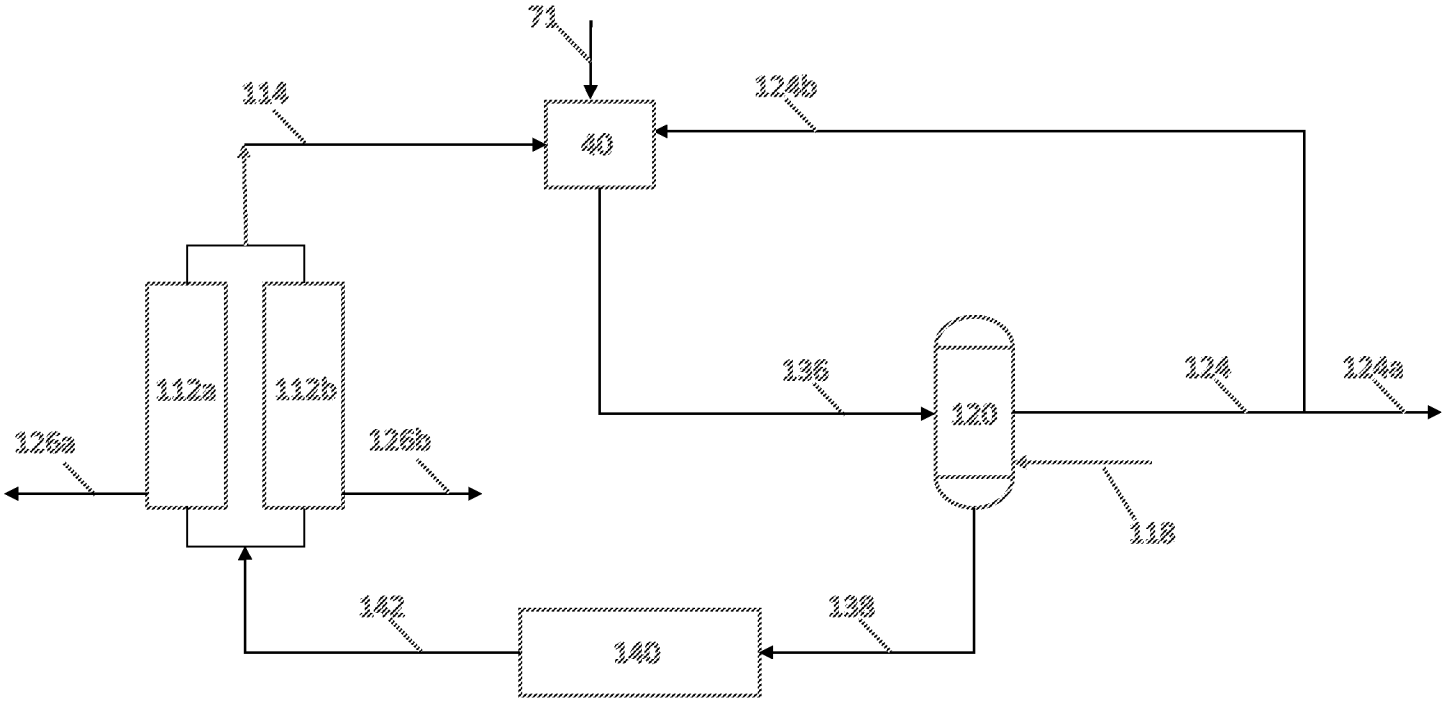
FIG. 3 is a process flow diagram of a delayed coking process according to one or more embodiments disclosed herein.

Referring now to FIG. 3, a process for delayed coking is illustrated. A coking unit is an oil refinery processing unit that converts the low value residual oil, or residua, from the vacuum distillation column or the atmospheric distillation column into low molecular weight hydrocarbon gases, naphtha, light and heavy gas oils, and petroleum coke. The process thermally cracks the long chain hydrocarbon molecules in the residual oil feed into shorter chain molecules. Coking is the preferred option for processing vacuum residues containing high level of metals because the metals end up in the coke by-product and are disposed of more easily and economically in this solid form. The liquid coker products are almost free of metals. The processing of heavy crude oils having high metals and sulfur content is increasing in many refineries, and as a result the coking operations are of increasing importance to refiners. The increasing concern for minimizing air pollution is another incentive for treating vacuum residues in a coker, since the coker produces gases and liquids having sulfur in a form that can be relatively easily removed from the product stream.

In one or more embodiments, the coking unit is a delayed unit, or a delayed coker. In a basic delayed coking process, fresh feedstock is introduced into the lower part of a fractionator. The fractionator bottoms including heavy recycle material and fresh feedstock are passed to a furnace and heated to a coking temperature. The hot feed then goes to a coke drum maintained at coking conditions where the feed is cracked to form light products while heavy free radical molecules form heavier polynuclear aromatic compounds, which are referred to as coke. With a short residence time in the furnace, coking of the feed is thereby delayed until it is discharged into a coking drum. The volatile components are recovered as coker vapor and returned to the fractionator, and coke is deposited on the interior of the drum. When the coke drum is full of coke, the feed is switched to another drum and the full drum is cooled and emptied by conventional methods, such as by hydraulic means or by mechanical means.

As illustrated, a pair of coking drums 112*a* and 112*b* may be utilized in order to permit continuous operation of the delayed coking process. The bottoms stream 71 (from fractionation unit 70 shown in FIGS. 1 and 2) containing the PNA compounds and/or HPNA compounds may be fed to mixing unit 40, along with overhead coker product 114 and an intermediate fraction recycle 124*b* to form a coking fractionator feed stream 136. Coking fractionator feed stream 136 may be fed to coking fractionator 120, along with a third hydrocarbon stream 118, which may act as a solvent or motive fluid for the delayed coking process. The coking fractionator 120 may separate the coking fractionator feed stream 136 into one or more components including an intermediate fraction 124 and a bottom fraction 138, containing the PNA compounds and/or HPNA compounds and one or more other hydrocarbons. Bottoms fraction 138 may be fed to coking unit furnace 140, producing a heated coker feed 142. Heated coker feed 142 may then be fed to coking drum 112*a* or 112*b*, with coking drums 112*a* and 112*b* operated in swing mode.

An intermediate hydrocarbon fraction 124 may be withdrawn from coking fractionator 120, a portion of which is removed via flow line 124*a* and may be further processed and/or blended in downstream refinery operations to produce gasoline, kerosene, diesel, or other fuel oils. The remaining portion of intermediate hydrocarbon fraction 124 which is not removed via flow line 124*a* may be recycled to mixing unit 124*b*.

As a product of the integrated hydrocracking and delayed coking process described herein, coke 126*a*, 126*b* may be recovered from the coking drums 112*a* and 112*b*, respectively. Depending on the type of feedstock used, the green coke may be calcined to produce needle, anode, or fuel coke.

Figure 4:
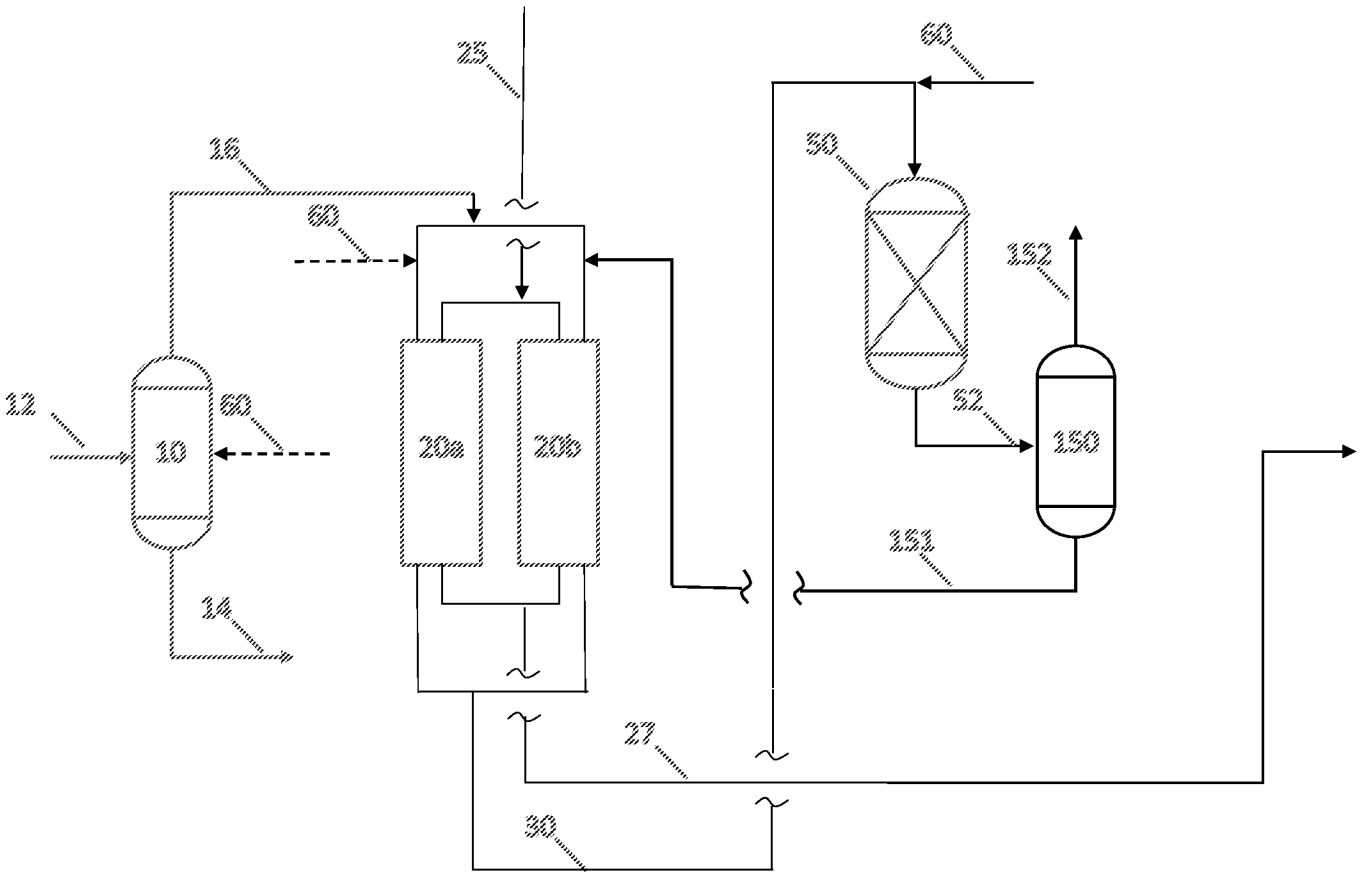
FIG. 4 is a process flow diagram of an adsorption process according to one or more embodiments disclosed herein.
Figure 5:
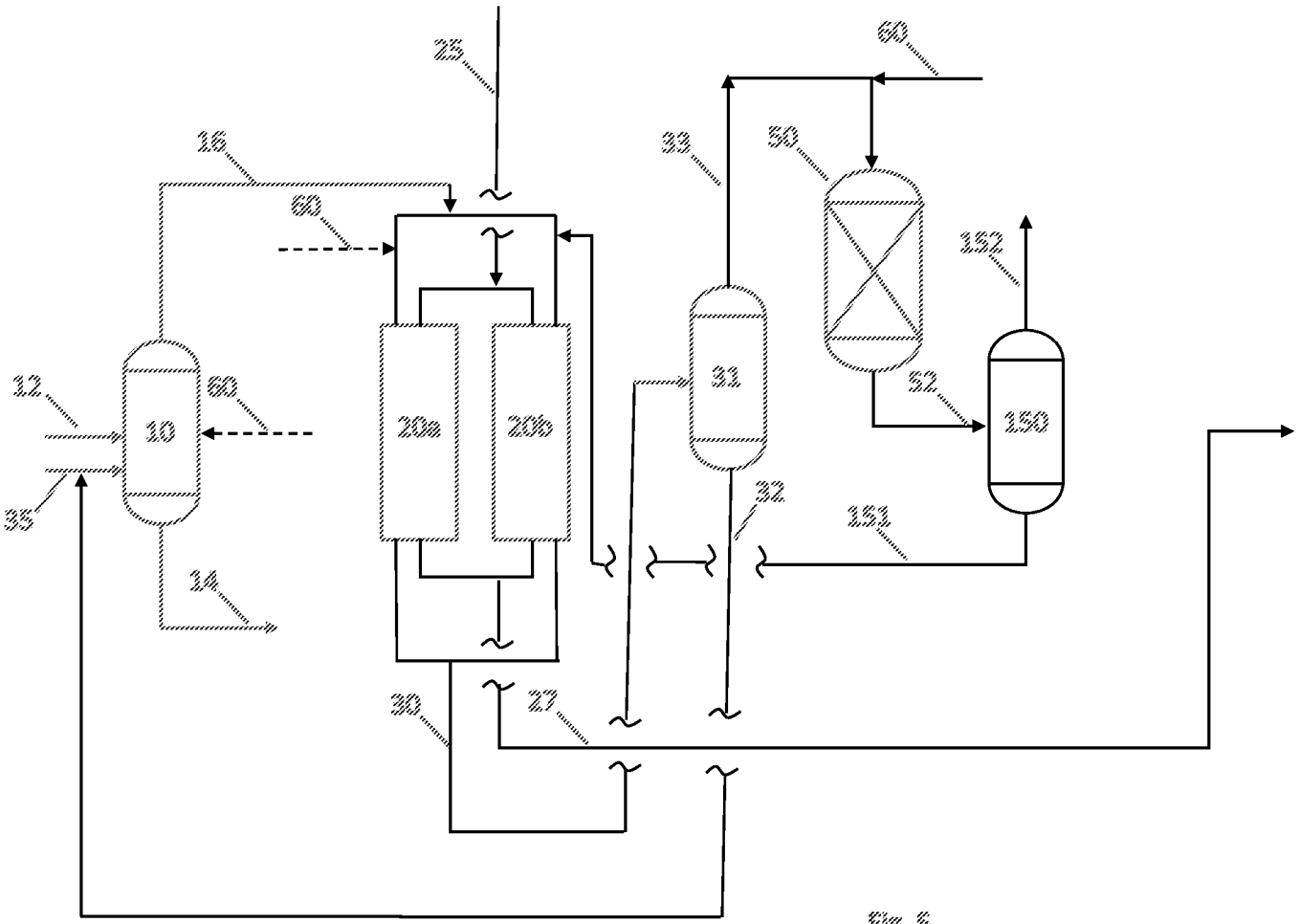
FIG. 5 is a process flow diagram of an adsorption process according to one or more embodiments disclosed herein.
Figure 6:
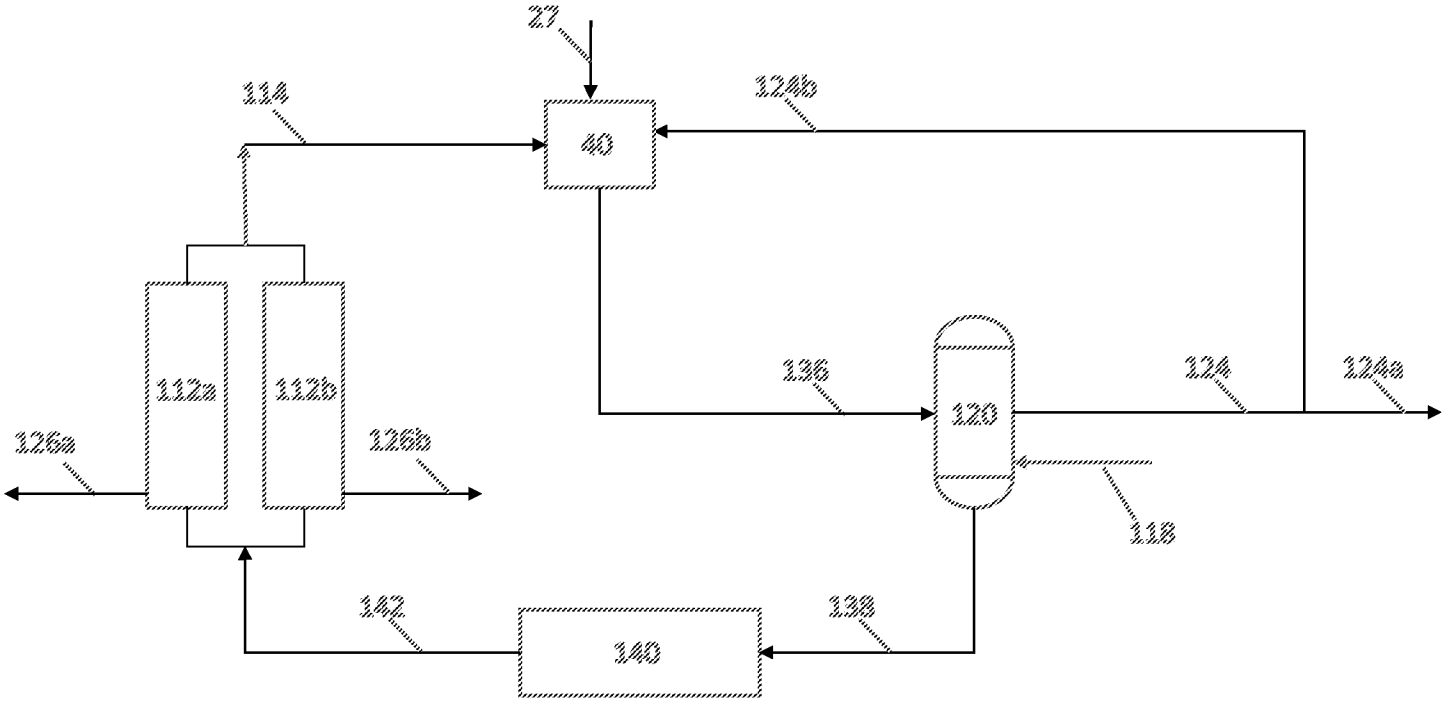
FIG. 6 is a process flow diagram of a delayed coking process according to one or more embodiments disclosed herein.

Referring now FIGS. 4, 5, and 6, a process where a carbon based adsorbent is used. FIGS. 4 and 5 are similar to FIGS. 1 and 2, while FIG. 6 is similar to FIG. 3, where like numbers represent like parts. Referring to FIG. 4, in one or more embodiments, adsorbers 20*a* and 20*b* may be loaded with fresh carbon based adsorbent 25. DMO/DAO 16 may be fed to adsorbers 20*a* and 20*b*, operated in swing mode producing an adsorbent-treated hydrocarbon stream 30 and a PNA compound and/or HPNA compound laded carbon based sorbent 27.

As is the case in FIGS. 1 and 2, the second heavy hydrocarbon feedstream 60, as illustrated in FIGS. 4 and 5, may be a hydrocarbon such as VGO from a vacuum distillation operation, may be fed to the hydrocracking reaction zone 50, or may be fed to the solvent de-metalizing or de-asphalting unit 10 with the heavy hydrocarbon feedstream and/or the hydrocracking reaction bottoms stream 12. In other embodiments, the second hydrocarbon feedstock 60 may be fed to the adsorbers 20*a* and 20*b* with the DAO/DMO 16

As illustrated in FIG. 6, the PNA compound and/or HPNA compound laded carbon based sorbent 27 may be fed to the delayed coking process to produce recovered coke 126*a*, 126*b*, and depending on the hydrocarbon feedstock 12 (FIGS. 4 and 5), needle, anode, or fuel grade coke may be produced.

Coke is the product obtained from a delayed coker operations and may converted to fuel grade (shot) coke, anode grade coke (sponge) and/or electrode grade coke (needle) by calcination. The coke quality depends on the quality of the feedstock processed. Feedstocks containing high concentrations of asphaltenes, metal and sulfur content, such as unprocessed hydrocrackers bottoms recycle streams, produce fuel grade coke while feedstocks with low level of contaminants produce higher grade coke such as needle or anode coke. The properties of different types of calcined cokes are shown in Table 1. As seen, the high quality coke is the needle coke, which has the lowest amount of contaminants, the low quality coke is the fuel coke which has the highest level of contaminant. Anode grade coke is an intermediate product.

TABLE 1

Properties of cokes

| Property | Units | Fuel Coke | Anode Coke | Needle Coke |
|---|---|---|---|---|
| Bulk Density | Kg/m$^3$ | 880 | 720-800 | 670-720 |
| Sulfur | W % (max) | 3.5-7.5 | 1.0-3.5 | 0.2-0.5 |
| Nitrogen | ppmw (max) | 6,000 | — | 50 |
| Nickel | ppmw (max) | 500 | 200 | 7 |
| Vanadium | ppmw | 150 | 350 | — |
| Volatile Combustible Material | W % (max) | 12 | 0.5 | 0.5 |
| Ash Content | W % (max) | 0.35 | 0.40 | 0.1 |
| Moisture Content | W % (max) | 8-12 | 0.3 | 0.1 |
| Hardgrove Grindability Index (HGI) | W % | 35-70 | 60-100 | — |

Advantageously, embodiments of the present disclosure provide an integrated hydrocracking and delayed coking process to produce various types of coke. In embodiments where hydrocracker bottoms recycle stream, which is high in HPNA, is used as feedstock 12, the integrated process herein may produce high levels of needle or anode coke. In embodiments where a fresh heavy hydrocarbon feedstream, which is high in PNA, is used as feedstock 12, the integrated process herein may produce high levels of fuel grade coke.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for the treatment of a hydrocracking unit bottoms stream containing heavy poly-nuclear aromatic (HPNA) compounds to produce needle coke, the process comprising:

a. feeding the hydrocracking unit bottoms stream, comprising 0.5 wt % or less sulfur-containing compounds and 50 ppmw or less nitrogen-containing compounds, and a non-polar solvent stream to a solvent de-asphalting unit to remove a portion of the metals, asphaltenes, nitrogen-containing compounds, and sulfur-containing compounds, producing a deasphalted oil (DAO) stream containing the DAO and the non-polar solvent, wherein the DAO has a boiling point between 450 and 800° C. and the non-polar solvent has an overall Hildebrand solubility parameter of less than 8.0 $(cal/cm^3)^{1/2}$ and a complexing solubility parameter of less than 0.5 and a field force parameter of less than 7.5;

b. contacting the DAO stream containing the DAO and the non-polar solvent with an effective amount of adsorbent material in an adsorption unit to produce an adsorbent laden with HPNA compounds and an adsorbent treated hydrocarbon stream, the adsorbent treated hydrocarbon stream further comprising the non-polar solvent;

c. feeding the adsorbent treated hydrocarbon stream comprising the non-polar solvent to an intermediate separation column to separate the non-polar solvent from the adsorbent treated hydrocarbon stream;

d. recycling the non-polar solvent to the solvent de-asphalting unit;

e. washing the adsorbent laden with HPNA compounds with one or more polar solvents to extract the HPNA compounds and produce a polar solvent effluent stream, wherein the polar solvent has the overall Hildebrand solubility parameter greater than 8.5 $(cal/cm^3)^{1/2}$, and the complexing solubility parameter of greater than 1 and field force parameter of greater than 8;

f. recovering and introducing the polar solvent effluent stream from the adsorption unit into a separation unit;

g. recovering the one or more polar solvents from the separation unit for re-use as the one or more polar solvents;

h. recovering the HPNA compounds from the separation unit;

i. subjecting the HPNA compounds to a delayed coking process for the formation of needle coke having a sulfur content of 0.2-0.5 wt %, a bulk density between 670 and 720 kg/m$^3$, a nitrogen content of less than or equal to 50 ppmw, nickel content of less than or equal to 7 ppmw, a volatile combustible material of 0.5 wt % or less, maximum ash content of 0.1 wt %, a maximum moisture content of 0.1 wt %, and a trace vanadium content.

2. The process of claim 1, wherein the adsorption unit further comprises a first adsorber and a second adsorber and the process further comprises:

operating the first adsorber in adsorption mode where the DAO stream is fed to the first adsorber to produce the adsorbent treated hydrocarbon stream; and operating the second adsorber in desorption mode where the one or more solvents are washing the adsorbent laden with HPNA compounds to produce the polar solvent effluent stream;

wherein, after a period of time, the first adsorber is switched to desorption mode and the second adsorber is switched to adsorption mode, thereby continuously producing the adsorbent treated hydrocarbon stream and the polar solvent effluent stream.

3. The process of claim 1, wherein subjecting the HPNA compounds to a delayed coking process further comprises:

feeding the HPNA compounds from the separation unit to a mixing unit, forming a coking fractionator feedstream;

feeding the coking fractionator feedstream to a coking fractionator;

separating the coking fractionator feedstream into a coker feedstream and an intermediate product stream;

feeding the coker feedstream to a coker unit furnace, forming a heating coker feedstream; and feeding the heated coker feedstream to a coking zone, producing an overhead coker product stream and a needle coke product stream.

4. The process of claim 3, further comprising feeding one or more of an intermediate product recycle stream and the overhead coker product stream to the mixing unit.

5. The process of claim 3, wherein the coking zone comprises a first coker unit and a second coker operated in parallel in a swing mode.

6. The process of claim 3, further comprising feeding a fresh hydrocarbon feedstock to the coking fractionator.

7. A process for the treatment of a hydrocracking unit bottoms stream containing heavy poly-nuclear aromatic (HPNA) compounds to produce needle coke, the process comprising:

a. feeding the hydrocracking unit bottoms stream, comprising 0.5 wt % or less sulfur-containing compounds and 50 ppmw or less nitrogen-containing compounds, and a non-polar solvent stream to a solvent de-asphalting unit to remove a portion of the metals, asphaltenes, nitrogen-containing compounds, and sulfur-containing compounds, producing a deasphalted oil (DAO) stream containing the DAO and the non-polar solvent, wherein the DAO has a boiling point between 450 and 800° C. and the non-polar solvent has an overall Hildebrand solubility parameter of less than 8.0 $(cal/cm^3)^{1/2}$ and a complexing solubility parameter of less than 0.5 and a field force parameter of less than 7.5;

b. contacting the DAO stream containing the DAO and the non-polar solvent with an effective amount of a carbon based adsorbent material in an adsorption unit to produce an adsorbent laden with HPNA compounds and an adsorbent treated hydrocarbon stream, the adsorbent treated hydrocarbon stream further comprising the non-polar solvent;

c. feeding the adsorbent treated hydrocarbon stream comprising the non-polar solvent to an intermediate separation column to separate the non-polar solvent from the adsorbent treated hydrocarbon stream;

d. recycling the non-polar solvent to the solvent de-asphalting unit;

e. recovering the adsorbent laden with the HPNA compounds from the adsorption unit;

f. subjecting the adsorbent laden with the HPNA compounds from the adsorption unit to a delayed coking process for the formation of needle coke having a sulfur content of 0.2-0.5 wt %, a bulk density between 670 and 720 $kg/m^3$, a nitrogen content of less than or equal to 50 ppmw, nickel content of less than or equal to 7 ppmw, a volatile combustible material wt % of 0.5, maximum ash content of 0.1 wt %, a maximum moisture content of 0.1 wt %, and a trace vanadium content.

8. The process of claim 7, wherein the adsorption unit further comprises a first adsorber and a second adsorber and the process further comprises:

operating the first adsorber in adsorption mode where the DAO stream is fed to the first adsorber to produce the adsorbent treated hydrocarbon stream; and operating the second adsorber in regeneration mode where the adsorbent laden with HPNA compounds is removed from the second adsorber and replaced with fresh carbon based adsorbent;

wherein, after a period of time, the first adsorber is switched to regeneration mode and the second adsorber is switched to adsorption mode, thereby continuously producing the adsorbent treated hydrocarbon stream and the adsorbent laden with HPNA compounds.

9. The process of claim 7, wherein subjecting the adsorbent laden with the HPNA compounds to a delayed coking process further comprises:

feeding the adsorbent laden with the HPNA compounds from the separation unit to a mixing unit, forming a coking fractionator feedstream;

feeding the coking fractionator feedstream to a coking fractionator;

separating the coking fractionator feedstream into a coker feedstream, and an intermediate product stream;

feeding the coker feedstream to a coker unit furnace, forming a heating coker feedstream;

feeding the heated coker feedstream to a coking zone, producing an overhead coker product stream and a needle coke product stream; and recovering the needle coke product stream.

10. The process of claim 9, further comprising feeding one or more of an intermediate product recycle stream and an overhead coker product stream to the mixing unit.

11. The process of claim 9, wherein the coking zone comprises a first coker unit and a second coker operated in parallel in a swing mode.

12. The process of claim 9, further comprising feeding a fresh hydrocarbon feedstock to the coking fractionator.

13. The process of claim 1, feeding the deasphalted oil (DAO) stream containing the DAO and the non-polar solvent to the adsorption unit without intermediate separation.

14. The process of claim 7, feeding the deasphalted oil (DAO) stream containing the DAO and the non-polar solvent to the adsorption unit without intermediate separation.

* * * * *